US006729804B1

(12) United States Patent
Roodenburg et al.

(10) Patent No.: US 6,729,804 B1
(45) Date of Patent: May 4, 2004

(54) CANTILEVERED TOWER FOR JACK-UP PLATFORM

(75) Inventors: Joop Roodenburg, Delft (NL); Robert Frodo Van Kuilenburg, Dordrecht (NL); Pieter Dirk Melis Van Duivendijk, Utrecht (NL)

(73) Assignee: Itrec B.V. (NL)

( * ) Notice: Subject to any disclaimer, the term of this patent is extended or adjusted under 35 U.S.C. 154(b) by 0 days.

(21) Appl. No.: 10/225,770

(22) Filed: Aug. 22, 2002

(51) Int. Cl.[7] ..... B63B 35/44
(52) U.S. Cl. ..... 405/201; 405/196; 175/5
(58) Field of Search ..... 405/196, 197, 405/199, 201; 175/5, 7, 9

(56) References Cited

U.S. PATENT DOCUMENTS

| | | | | | |
|---|---|---|---|---|---|
| 4,224,005 | A | * | 9/1980 | Dysarz | 405/196 |
| 4,401,398 | A | * | 8/1983 | Remson | 405/201 |
| 4,483,644 | A | * | 11/1984 | Johnson | 405/201 |
| 4,602,894 | A | * | 7/1986 | Lorenz et al. | 405/203 |
| 4,668,127 | A | * | 5/1987 | Steele | 405/198 |
| 4,823,870 | A | * | 4/1989 | Sorokan | 166/79.1 |
| 4,938,628 | A | * | 7/1990 | Ingle | 405/201 |
| 5,032,040 | A | * | 7/1991 | Ingle | 405/201 |
| 5,052,860 | A | * | 10/1991 | Ingle | 405/201 |
| 5,139,367 | A | * | 8/1992 | Ingle | 405/201 |
| 6,171,027 | B1 | | 1/2001 | Blankestijin | 405/201 |
| 6,390,732 | B1 | * | 5/2002 | Kristensen et al. | 405/201 |
| 6,491,477 | B2 | * | 12/2002 | Bennett et al. | 405/201 |
| 6,536,540 | B2 | * | 3/2003 | de Boer | 175/70 |
| 6,595,494 | B1 | * | 7/2003 | Roodenburg et al. | 254/277 |

FOREIGN PATENT DOCUMENTS

| | | | | |
|---|---|---|---|---|
| GB | 1089313 | * | 11/1967 | |
| GB | 2165188 A | * | 4/1986 | B63B/35/00 |

* cited by examiner

*Primary Examiner*—Robert E. Pezzuto
*Assistant Examiner*—Tara L. Mayo
(74) *Attorney, Agent, or Firm*—Wendy Buskop; Buskop Law Group, P.C.

(57) ABSTRACT

A Jack Up drilling rig having a deck capable of being used offshore made of a cantilever which is mounted so as to be moveable in a first direction and a second direction, a Multi Purpose Tower fixably mounted on the cantilever, a supporting cart disposed between the cantilever and the deck of the Jack Up drilling rig, and at least four friction reducing devices, wherein the Jack-Up drilling rig is also used in methods for installing and decommissioning drilling equipment on a sub-sea well.

15 Claims, 10 Drawing Sheets

CANTILEVERED TOWER FOR JACK-UP PLATFORM

FIELD OF THE INVENTION

The present invention relates to a drilling rig in the form of a jack-up platform on which a cantilever is mounted so as to be movable at least substantially horizontally and in a first direction, with the cantilever projecting more or less outside the jack-up platform, while a Multi Purpose Tower is further present on the cantilever, said Multi Purpose Tower being movable relative to the jack-up platform in a second direction, different from the first direction.

BACKGROUND OF THE INVENTION

In the conventional drilling rigs, the cantilever is movable only in its longitudinal direction relative to the jack-up platform, and the drilling platform is movable relative to the cantilever in a direction transverse thereto. Due to the resulting movement of the drilling platform relative to the jack-up platform, the drilling point of the drilling rig can reach any point located in a rectangle of which the lengths of the sides are determined by the travel of the cantilever relative to the jack-up platform and the travel of the drilling platform relative to the cantilever.

In the transverse direction, the distance between the cantilever beams, which determine the width of the cantilever, extending in the longitudinal direction limits the size of this rectangle. Located under the drilling platform is a grid of drilling points. The drilling platform with the blow-out valve and a part of the equipment, tools and materials for drilling that are further required moves from one drilling well to the other. As a consequence, the drilling pattern is limited to drillings within the rectangular shape.

A need has existed for a cantilever-drilling platform, which is more movable than these bidirectional platforms.

In the drilling rig according to the prior art (see patent no U.S. Pat. No. 6,171,027 for an example), the cantilever and tower are movable on load bearing plates and/or rollers, which are running over rails. These rails are fixed into the deck or are formed of a three-part housing that workers can trip over as they move along the deck. Accidents of all sorts have occurred with the presence of the rails or three part housings on the deck of the Jack Up rig. Furthermore these rails considerably limit the number of possible uses of the deck areas on which said rails are fixed.

In a drilling rig according to prior art a drilling derrick is fixable mounted on the cantilever. One of the properties of a drilling derrick is a large base needed for stability. This large base determines the minimum width of the cantilever and consequently the weight of the cantilever. A smaller width means a larger drilling area that can be reached and said drilling derrick limits the drilling area to a considerably content. Another disadvantage of a drilling derrick is the relative inaccessibility of the drill floor due to the large number of structural beams that are in the way. This severely limits the possible number of useful applications that can be performed on the drilling derrick.

A need exists for a cantilever with a drilling platform that does not have load bearing plates or rails or rollers so that that cantilever can move theoretically over whole deck of the jack up.

A need exists for a cantilever with a drilling platform that has a moving system for the cantilever that has fewer parts, thereby creating a unit that has lower maintenance cost and lower cost to construct.

A need also exists for a cantilever with a drilling platform that has one unit sliding bearings for two different directions to reduce friction between the cantilever and the deck.

A need also exists for a cantilever with a drilling platform that has a lower weight construction of cantilever and drilling tower, a smaller cantilever width, and an increased accessibility of the drill floor increasing the number of possible kinds of work that can be performed.

The invention herein is designed to satisfy the above-mentioned needs.

SUMMARY OF THE INVENTION

The invention relates to a Jack-Up drilling rig having a deck capable of being used offshore. The Jack-Up drilling rig is made of a cantilever that is mounted so as to be moveable in a first direction and a second direction, a Multi Purpose Tower fixably mounted on the cantilever, a supporting cart disposed between the cantilever and the deck of the Jack Up drilling rig, and at least four friction reducing devices.

The invention is also a method for installing drilling equipment on a sub-sea well and drilling the well using the Jack-Up drilling rig.

The invention is also a method for decommissioning a well using the Jack-Up drilling rig.

BRIEF DESCRIPTION OF THE DRAWINGS

The present invention will be explained in greater detail with reference to the appended figures, in which.

TAILED DESCRIPTION OF THE PREFERRED EMBODIMENTS

Figure 1:
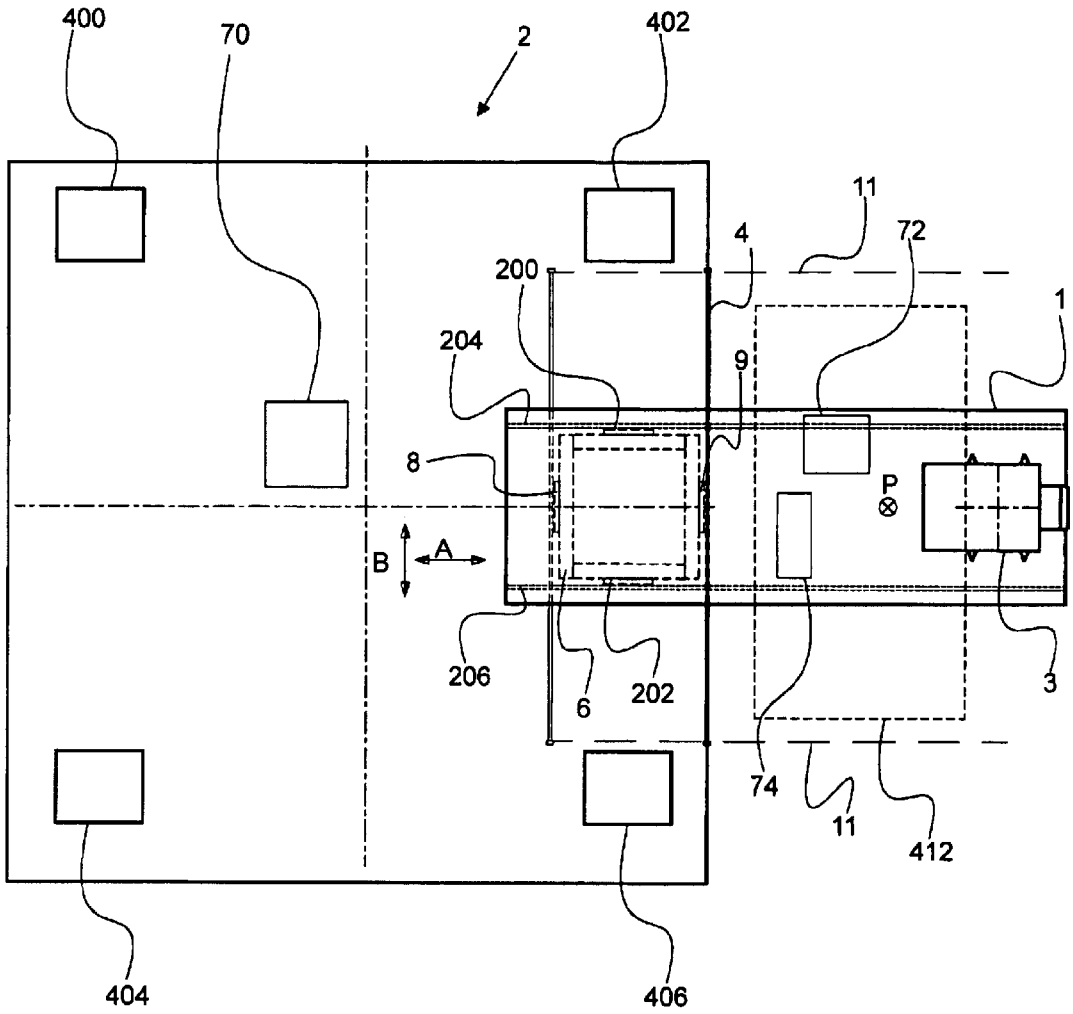
FIG. 1 is a top plan view of a cantilever on a Jack-Up.

Before explaining the present invention in detail, it is to be understood that the invention is not limited to the particular embodiments and that it can be practiced or carried out in various ways.

The invention relates to a drilling rig for use in the offshore industry in the form of a Jack Up platform on which a cantilever is mounted so as to be movable at least in two directions, with the cantilever projecting more or less outside the Jack Up platform. On the cantilever a Multi Purpose Tower is present, which Multi Purpose Tower is moveable relative to the Jack Up platform in a second direction, different from the first direction. This Multi Purpose Tower is fixedly mounted on the cantilever and preferably forms an integral part of the construction of the cantilever.

An object of the invention is to provide a drilling rig wherein the above-mentioned drawbacks are avoided at least to a considerable extent. To this end, according to the invention, the drilling rig having a Multi Purpose drilling tower mounted on the cantilever and said cantilever is movable relative to the jack-up platform in at least two directions and optionally can rotate.

As a result, the drilling point always remains in the same place relative to the cantilever, viz. preferably centrally between the two cantilever sidewalls. This leads to a symmetric load on the cantilever and offers the possibility of giving the cantilever a lighter construction.

A Multi Purpose drilling tower has a very small base compared to a normal drilling derrick thus avoiding the need to construct a wide cantilever. This increases the area the cantilever can reach. Thus a larger drilling pattern can be obtained than is possible with the conventional drilling rigs using a conventional drilling derrick.

Although the cantilever with the Multi Purpose Tower for a Jack Up rig is movable in two directions by extending the cantilever in its longitudinal direction and rotating it about a fixed point on the jack-up platform, the cantilever is preferably constructed for movement in its longitudinal direction with the cantilever projecting more or less outside the jack-up platform, and in a direction relative to the jack-up platform which is transverse to the first movement.

To enable these movements in an efficient manner, a supporting cart under the cantilever is used, which is movable with the cantilever over the deck of the jack-up platform.

In one embodiment, the supporting cart is slidable by means of relevant operating cylinders over the deck of the jack-up platform guided by guiding plates removably secured on the jack-up platform and extending in the transverse direction. Because the guiding plates do not have to bear the weight of the cantilever with installed equipment these plates can be of a relative lightweight construction. The guiding plates when not in use can be increasing the useful space on the deck.

When the supporting cart slides over the deck on the jack-up platform (transversal cantilever movement) or when the bottom plate of the cantilever slides over the supporting cart (longitudinal cantilever movement), considerable shearing forces occur. In order to at least partially relieve the parts sliding over each other in this regard, at least the two sliding bearing members that are movable over the deck located closest to the edge of the jack-up platform may comprise friction-reducing means which are operative in the longitudinal direction as well as in the transverse direction, to take up at least a part of the frictional forces between the sliding bearings mounted on the supporting cart and the relevant deck area and between the bottom plate area of the cantilever and the other sliding bearings on the supporting cart. In a concrete embodiment, these friction-reducing means are formed by hydrostatic bearings incorporated in the sliding bearings. In this regard, it is advantageous when the pressure exerted on the relevant deck areas by the friction-reducing means is settable. To generate the hydrostatic pressure for the hydrostatic bearings it is contemplated that existing pumps on the drilling rig can be used.

The invention can now be understood with reference to the Figures.

FIG. 1 is a top plan view of a cantilever (1) that is placed on the Jack-Up platform (2). The cantilever (1) is movable in its longitudinal direction as indicated by the arrow A, and in its transverse direction as indicated by the arrow B. In an alternative embodiment, the cantilever (1) can rotate around an axis.

Cantilever (1) and the Jack-Up platform (2) form part of a drilling rig capable of being moved by tugs to a specific location at sea, after which the Jack-Up platform 2 can be positioned on the seabed by posts (400), (402), (404) and (406) that can be moved downwards.

Also on this rig, but not shown in FIG. 1, are various spaces, accommodations, cranes, a helicopter platform, equipment and further accessories that may be important for a marine drilling rig. For example, FIG. 1 depicts a drill mud pump (70), a shaker (72), and a centrifuge (74) located on the rig.

Figure 2:
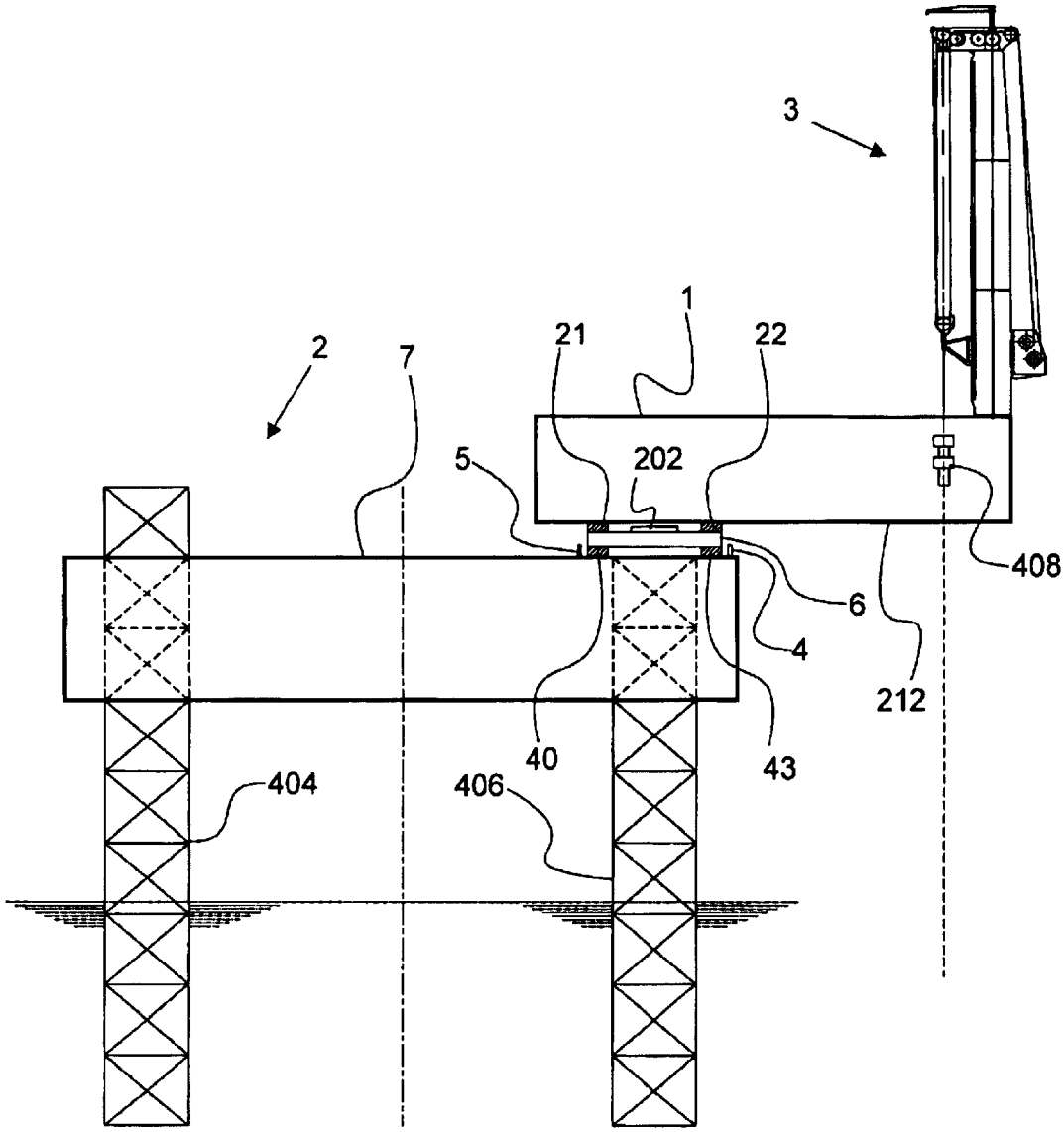
FIG. 2 is a side view of a cantilever on a Jack-Up.

Located on the cantilever (1) is Multi Purpose Tower (3). FIG. 1 and FIG. 2 also show that cantilever (1) is supported on Deck (7) by supporting cart (6) guided by first guiding plate (4), second guiding plate (5) and moved by first push pull unit (8) and second push pull unit (9). The third push pull unit (200) and fourth push pull unit (202) moves the cantilever (1). A detailed view of push pull unit (8) is given in FIG. 5.

FIG. 2 shows a side view of a Jack Up rig with the multi purpose tower (3) from the view where the third post (404) and fourth post (406) can be viewed. Tower (3) is on the cantilever (1). Cantilever (1) has a bottom plate (212), which rests on the bearings (19), (20), (21) and (22) mounted on supporting cart (6), which rests on bearings (40), (41), (42) and (43) on Deck (7) of the Jack Up rig (2). In FIG. 2 only bearings (21), (22), (40) and (43) are visible.

The fourth push pull unit (202) in this view moves the cantilever (1) in longitudinal direction. Two guiding plates are disposed on either side of cantilever (1), namely first cantilever guiding plate (204) and second cantilever guiding plate (206), shown in FIG. 3. A blowout prevention valve (408) is secured to the cantilever, and it should be noted that further equipment, tools and materials required for drilling could be secured to the cantilever.

In this embodiment, the Multi Purpose Tower (3) is fixedly attached to cantilever (1) and hence moves along therewith in the directions indicated by the arrows A and B with the cantilever. It is contemplated that the Multi Purpose tower could be removably detachable to the cantilever and be usable in the scope of the invention. However it should be noted that in a preferred embodiment Multi Purpose Tower (3) and cantilever (1) form one L-shaped load bearing structure. By integrating the two structures significant weight can be saved.

It should be noted that in a preferred embodiment, the guiding plates (4) and (5) extend in the direction B as indicated in FIG. 1. Guiding plates (4) and (5) can also be of shorter length and removably attached to Deck (7). After passage of Cantilever (1) the plates can be dismounted thereby freeing the deck from obstacles.

Figure 3:
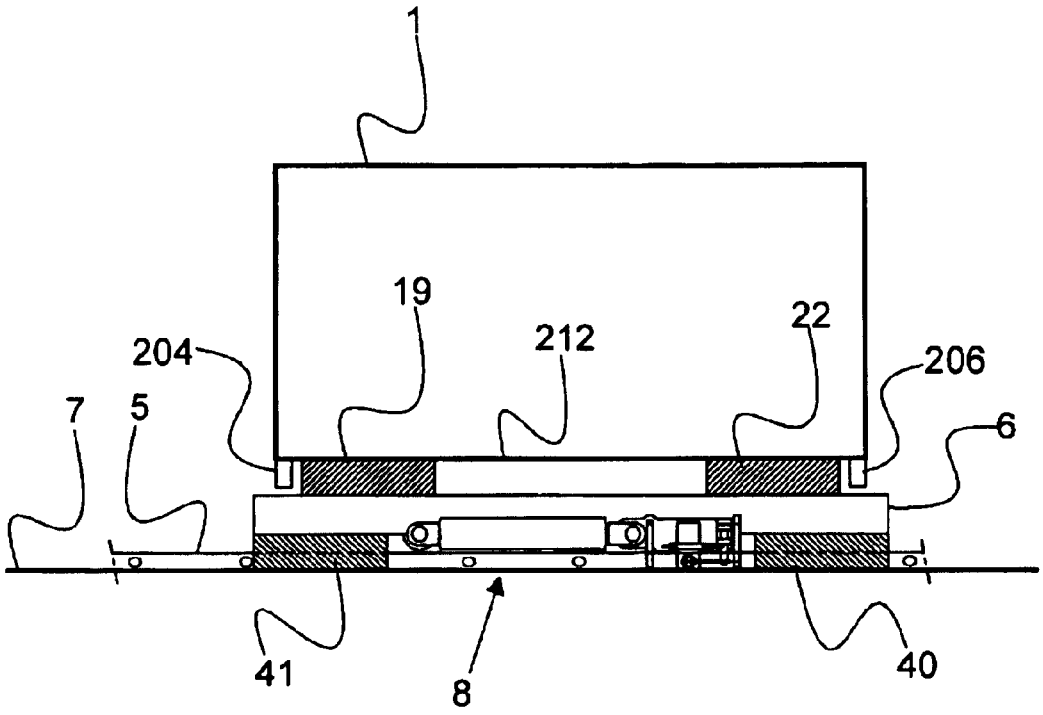
FIG. 3 is a view from the side facing away from the Jack-Up platform.

FIG. 3 reveals that according to one embodiment of the invention, a support cart (6) can be placed over the deck (7) of the Jack-Up platform. The supporting cart (6) is movable in direction B guided by guiding plate (4) and guiding plate (5) the latter of which is shown in FIG. 2. Guiding plates (4) and (5) can act as locking plates onto which the first push pull unit (8) and second push pull unit (9) shown in FIG. 1, can lock to move the supporting cart (6). It is contemplated that Deck (7) can also be used as locking device for push pull units (8) and (9).

It should be noted that although a supporting cart is a preferred embodiment other embodiments are possible in which the cantilever slides directly over the deck of the Jack Up. In this embodiment the sliding plates that are described in a later section are directly mounted on the cantilever.

The supporting cart (6) acts as carrier for the cantilever (1). Most preferably, the cantilever (1) is movable over the supporting cart (6) in the direction A indicated in FIG. 1. FIG. 3 also shows the cantilever bottom plate (212) supported on the first slide plate (19) and the fourth slide plate (22) mounted on supporting cart (6). The movement of the cantilever (1) over the supporting cart (6) is guided by first cantilever guiding plate (204) and second cantilever guiding plate (206) both of which are preferably fixably mounted on the cantilever (1). These guiding plates can also act as locking plates for a third push pull unit (200) and fourth push pull unit (202). These are shown as disposed on supporting cart (6) in FIG. 1. It is contemplated that bottom plate (212) can also be used as locking device for push pull units (200) and (202).

Cantilever (1) is movable back and forth along the edge of the Jack-Up platform (2) by moving the supporting cart (6) over the deck (7) of Jack-Up (2), through a distance between first end position (11) and a second end position (10). See FIG. 1 for indication of first end position (11) and second end position (10).

Through the movement described above can be made by cantilever (1) with Multi Purpose Tower (3) positioned thereon, this movement is in the shape of a rectangle (412). This drilling rectangle (412) is shown in FIG. 1, is located centrally below Multi Purpose Tower (3).

In FIG 1, point P indicates the location where drilling takes place. The size of the drilling pattern can be enlarged by increasing the drilling rectangle (412) or, in other words, by increasing the distance through which cantilever (1) can be shifted in the directions A and B.

Figure 5:
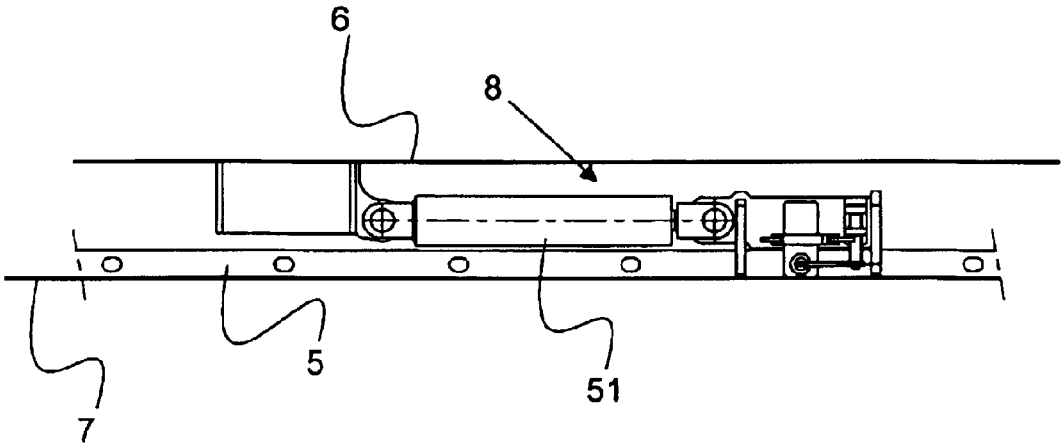
FIG. 5 is an enlarged view of the transversal cantilever moving system.

FIG. 5 is a detailed view of push-pull unit (8) the working of which is well known from prior art with moving cylinder (51) shown. Push-pull unit (8) is used to move supporting cart (6) in transversal direction.

The manner in which the supporting cart (6) slides over the deck (7) and the manner in which the cantilever (1) slides over the supporting cart (6) is always the same, to the effect that the slide plates for the deck (7) are of the same design and construction as the slide plates for the cantilever (1).

Figure 6:
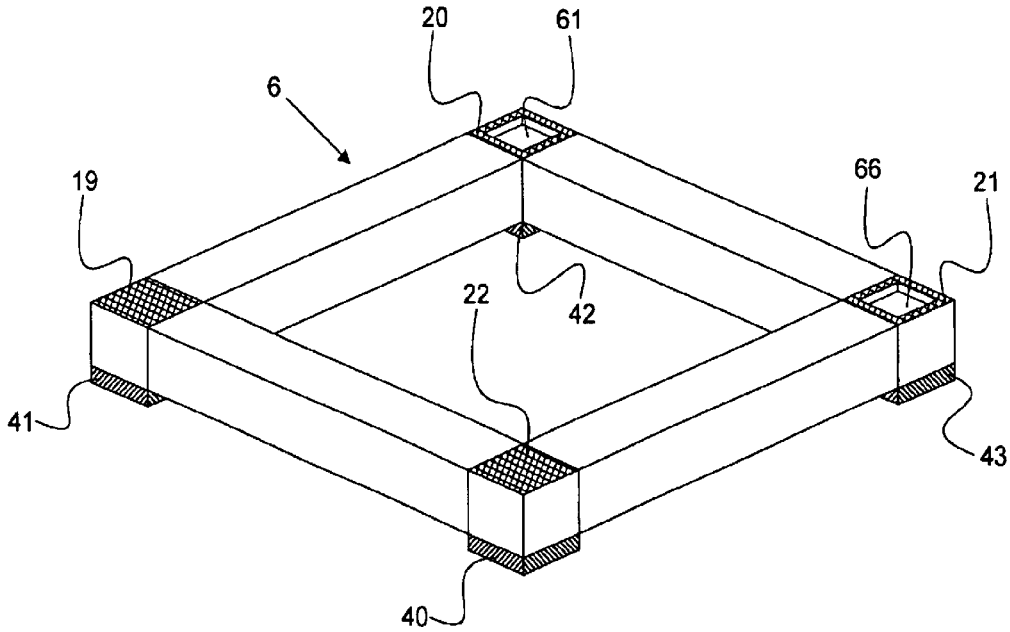
FIG. 6 is a perspective view of the supporting cart for holding the tower on tile cantilever.

FIG. 6 shows a preferred embodiment of cart (6) in which only one sliding plate is used per corner, which slides on side on deck (7), and on the other side on bottom plate (212). Slide plates are movable over cantilever bottom plate (212) and deck (7). Slide plates (19), (20), (21), (22), (40), (41), (42), and (43) are made from a material having good wear and corrosion properties, preferably an aluminum-bronze alloy. These slide plates are fixably mounted on the supporting cart (6).

Figure 7:
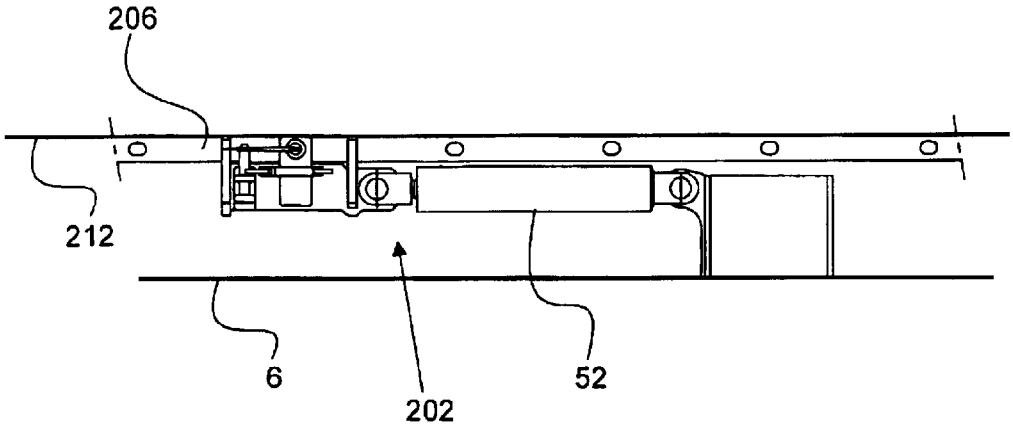
FIG. 7 is an enlarged view of the transversal cantilever moving system.

FIG. 7 is an enlarged view of push-pull unit (202) the working of which is well known from prior art with moving cylinder (52) shown. Push pull unit (202) is used to move cantilever (1) in longitudinal direction. The design and construction of push-pull unit (202) is the same as push-pull unit (8) and (9) as can be seen from FIG. 5.

Returning to FIG. 1, first push pull unit (8) and second push pull unit (9) lock the supporting cart (6) to guiding plate (4) and guiding plate (5). Push pull unit (200) and push pull unit (202) lock the cantilever (1) on the supporting cart (6).

Movement of the supporting cart (6) is accomplished in the transverse direction using push pull units (8) shown in FIG. 5 and (9) shown in FIG. 1. The push-pull units (8) and (9) are activated simultaneously and can be synchronized for similar force and movement on the cart. Likewise, the cantilever (1) is shifted in the longitudinal direction over sliding bearings by push pull units (200) and (202) activated in synchronization.

Because of the weight of the drilling platform with accessories, reactive forces will occur in the sliding plates, however, it is noted that these reactive forces will be considerably greater in sliding plates (42), (43), (20) and (21) than in sliding plates (19), (22), (41) and (40).

As a consequence, the frictional forces experienced by sliding plates (42). (43), (20) and (21) during shifting over deck (7) and the frictional forces occurring in these sliding plates during a displacement of cantilever (1) in the longitudinal direction will be considerably greater than the frictional forces experienced by the sliding plates (19), (22), (41) and (40) during shifting over the deck respectively the frictional forces occurring in the latter sliding plates during a displacement of the cantilever in the longitudinal direction.

For this reason, sliding plates (42), (43), (20) and (21) can be bearings, such as hydrostatic bearings with chambers in which water or another suitable fluid under high pressure can be pumped. The water will lower the friction of the bearing considerably. The high pressure can be generated by pumps already in place on the drilling rig such as mud-pumps or jetting pumps.

Figure 8:
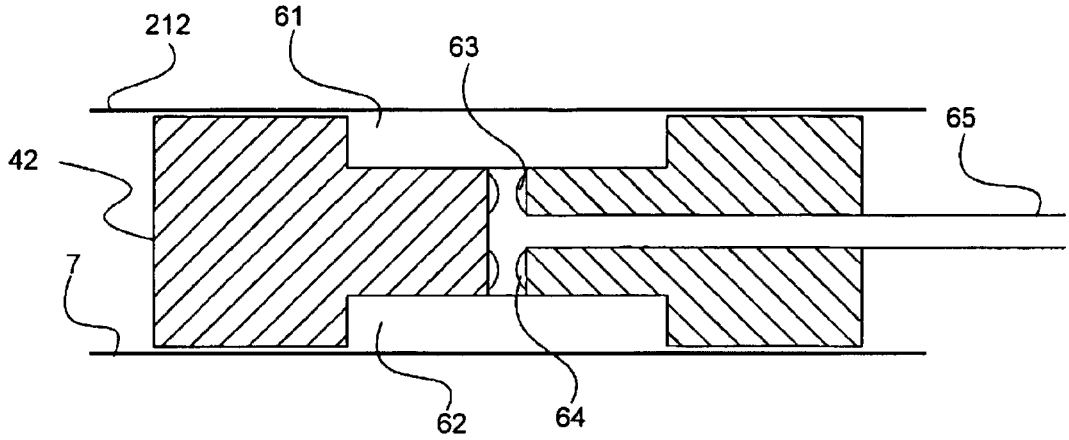
FIG. 8 is a detailed view of a bearing with hydrostatic friction reduction used for moving the cantilever with tower.

FIG. 8 shows the hydrostatic bearing embodiment for sliding plate (42) with the location of first chamber (61), second chamber (62), first resistance (63), second resistance (64) and fluid inlet (65). In this embodiment sliding plate (42) both slides over deck (7) and over bottom plate (212).

Figure 4:
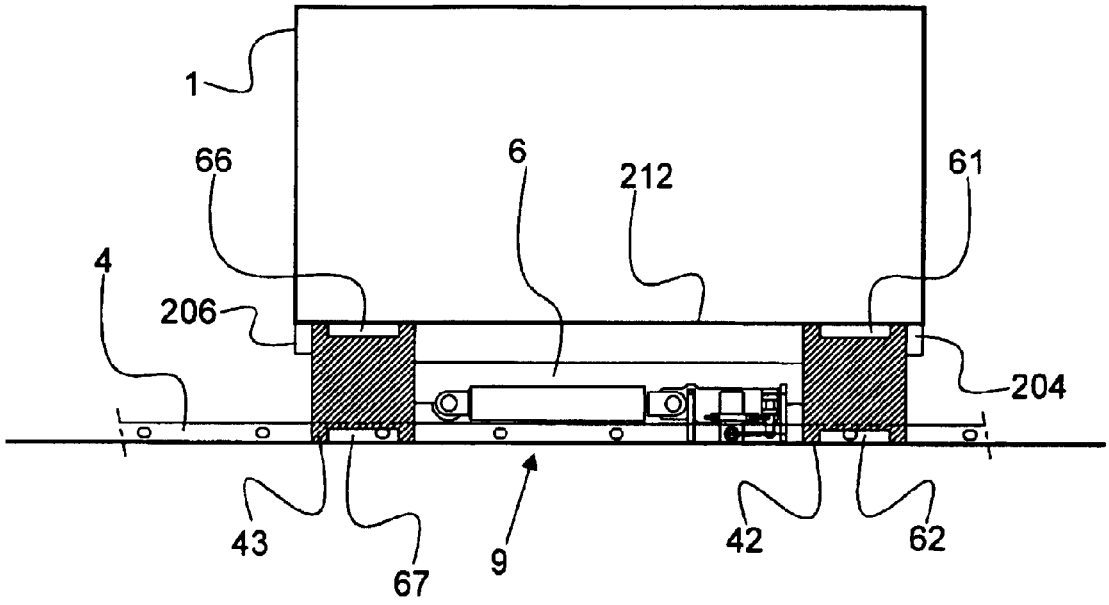
FIG. 4 is a view from the side facing the Jack-Up platform.

FIG. 4 shows a side view showing an embodiment in which sliding plates (43) and (42) have two sliding faces on opposite sides. One side sliding over deck (7) and one side on which cantilever bottom (212) slides. Sliding plates (42) and (43) have hydrostatic bearing chambers (61), (62), (66) and (67).

The mobility of the cantilever (1) with Multi Purpose Tower (3) fixed on it make the combination more attractive for use with high-pressure pumps and other drilling equipment on cantilever (1). Now, flexible high-pressure lines are entirely avoided. Between the Jack-Up platform and the cantilever, low-pressure connections are now sufficient; fixedly mounted on the cantilever, extending in a longitudinal direction towards the drilling platform.

Figure 9:
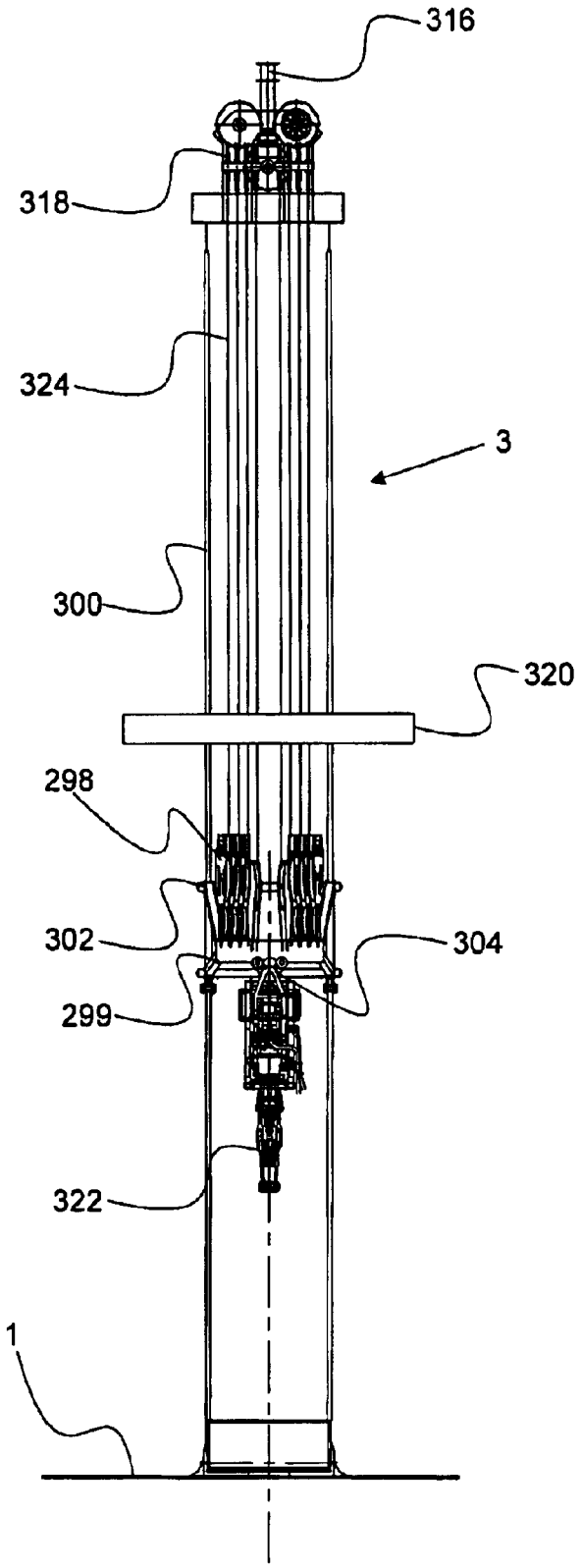
FIG. 9 is a front view of a Multi Purpose Tower which can be placed on the cantilever.
Figure 10:
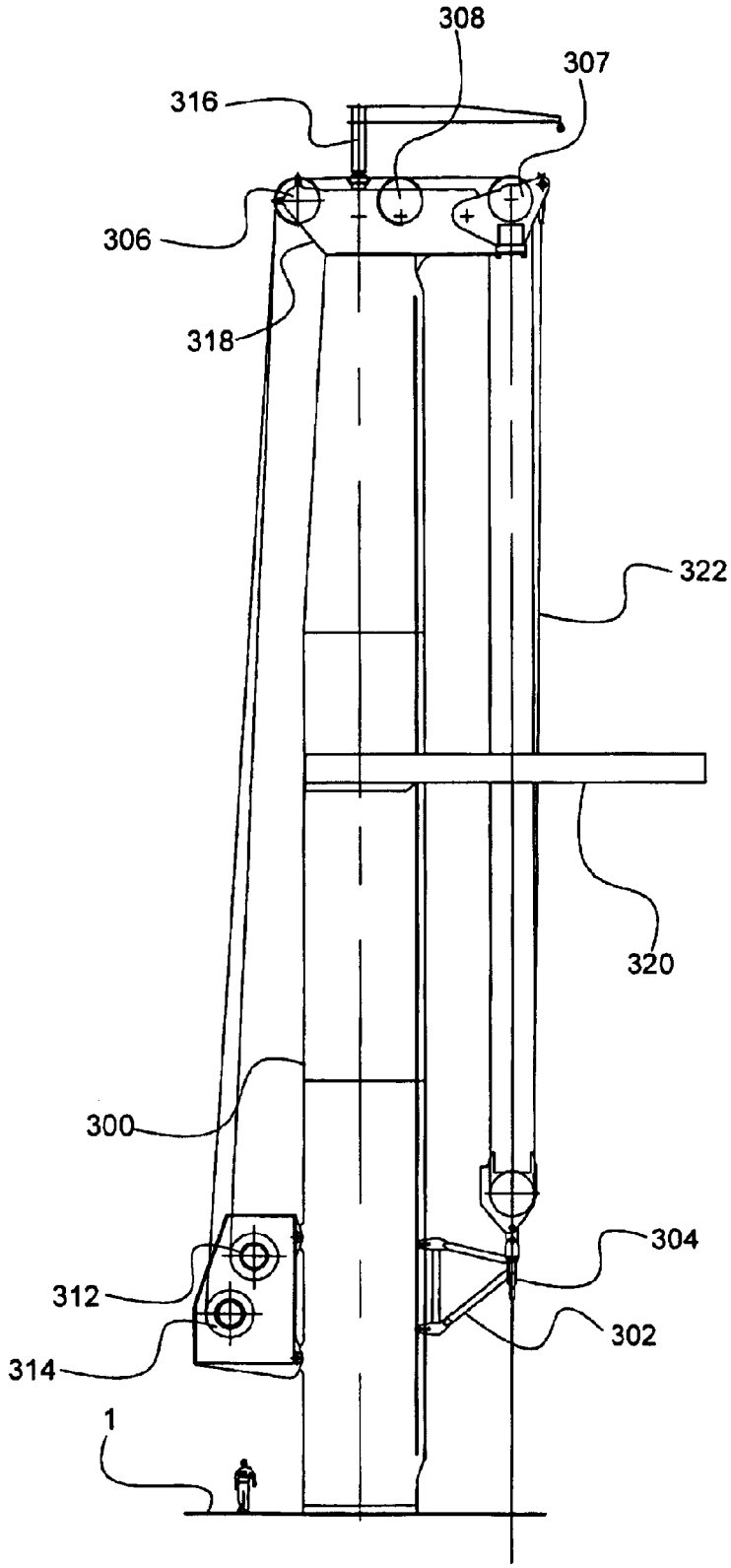
FIG. 10 is a side view of the Multi Purpose Tower of FIG. 9.

FIG. 9 shows a front view of a Multi Purpose Tower (3) comprising a mast (300) provided with cable blocks (298), a trolley (302) moveable fixed to the mast (300), and having a bottom side (299) provided with a gripper (304), at least one hoisting cable (324), a plurality of winches of which two are shown (312) and (314) in FIG. 10, and wherein the hoisting cable is guided over cable blocks of the mast and trolley, and the trolley is movable relative to the mast using the hoisting cable. On top of Multi Purpose Tower (3) a service crane (316) can be mounted. The topside of the mast (300) is formed by a masthead (318). A large number of cable sheaves are fixed in the mast head (306). A possible load is top drive (322).

It is advantageous according to the invention for the mast to be designed in the form of a tube or sleeve. The mast can be a modular mast made from containers connected together the mast can be rectangular, octagon or any number of geometric shapes. The mast is preferably hollow with a housing of steel but other materials could be used which have the strength of steel. The mast could be solid.

The Multi Purpose Tower can have a single hoist, dual hoist, or multiple hoist system. In parallel with the number of hoists, a corresponding number of winches can be used. In a preferred embodiment, there are two winches per hoist.

The winches each preferably secure an end of the hoisting cable. A small motor preferably drives each winch. The winches can have one or more brakes, such as slip brakes. The hoist cables can be placed on the outside or the inside of the mast.

FIG. 10 shows a side view of the Multi Purpose tower, which can be secured to the cantilever. Multi Purpose Tower (3) is mounted on cantilever (1). The mast (300), at the top has a service crane (316). Cable sheaves (306), (307) and (308) assist in the movement of cable over the tower. The crown head (318) is located at the top of the mast. Supporting structure (320) is secured to the mast. A first and second winch, (312) and (314) can be used to hoist the loads. Due to the box structure of Multi Purpose tower (3) integration of the structure of the Multi Purpose tower with the structure of cantilever (1) is simple. In this way the construction can be made lighter.

The invention is by no means limited to the exemplary embodiment described hereinabove, but comprises various modifications hereto, in so far as they fall within the scope of the following claims.

This invention contemplated a method for installing drilling equipment on a sub-sea well and drilling the well comprising:

a. placing a Jack-Up platform with drilling equipment and a cantilever and Multi Purpose Tower near a jacket with a well;

b. orienting the cantilever above the wellhead; using a translational and longitudinal movements;

c. picking up drill equipment from the jack-up platform using a multi purpose tower wherein said tower comprises a mast, on the top side provided with cable blocks fixedly connected to it; a trolley, which is movably fixed on the mast, on the top side is provided with cable blocks, and on the bottom side is provided with a gripper; hoist, a hoisting cable attached to the hoist and a winch, the hoisting cable being guided over the cable blocks of both the mast and the trolley, and it being possible to move the trolley relative to the mast with the aid of the hoist;

d. placing drilling equipment on the well;

e. connecting the equipment to the well; and f. drilling the well the invention also contemplates a method for decommissioning a well comprising:

a. placing a jack-up platform with drilling equipment and a cantilever and multi purpose tower near a well;

b. orienting the cantilever above the wellhead; using translational and longitudinal movement;

c. disconnecting the drilling equipment from the sub-sea well;

d. picking up the drilling equipment using a multi purpose tower wherein said tower comprises a mast, on the top side provided with cable blocks fixedly connected to it; a trolley, which is movably fixed on the mast, on the top side is provided with cable blocks, and on the bottom side is provided with a gripper; hoist, a hoisting cable attached to the hoist and a winch, the hoisting cable being guided over the cable blocks of both the mast and the trolley, and it being possible to move the trolley relative to the mast with the aid of the hoist; and e. placing drilling equipment on the jack-up platform.

While this invention has been described with emphasis on the preferred embodiments, it should be understood that within the scope of the appended claims, the invention might be practiced other than as specifically described herein.

What is claimed is:

1. A system capable of being used offshore comprising:

a. a Jack-up drilling rig having a deck;

b. a cantilever which is mounted so as to be moveable in a first direction and a second direction for offshore use;

c. a multi purpose tower fixably attached to the cantilever;

d. a supporting cart disposed between the cantilever and the deck of the Jack Up drilling rig;

e. at least four friction reducing devices secured to the supporting cart.

2. The system of claim 1, wherein the supporting cart further comprises at least two cylinders mounted thereto for moving the cantilever over the Jack Up drilling rig.

3. The system of claim 2, wherein said cylinders are hydraulic.

4. The system of claim 1, wherein the friction reducing devices are attached to the supporting cart for taking up at least a part of the frictional forces between the cantilever, Jack Up rig and supporting cart.

5. The system of claim 1, wherein said drilling rig further comprises at least one drill mud pump disposed on the cantilever or below deck in the Jack-Up.

6. The system of claim 1, wherein said drilling rig further comprises at least a blowout preventer (BOP), a shaker, and a centrifuge.

7. The system of claim 1, wherein the construction of said cantilever and said Multi Purpose tower has mainly an L-shape.

8. The system of claim 1, wherein said Multi Purpose Tower comprises a mast, on the top side provided with cable blocks fixedly connected to it; a trolley, which is movably fixed on the mast, and on the bottom side is provided with a gripper; a hoisting cable attached a winch, the hoisting cable being guided over the cable blocks of both the mast and the trolley, and it being possible to move the trolley relative to the mast with the aid of the hoisting cable.

9. A system capable of being used offshore comprising:

a. a Jack-up drilling rig having a deck;

b. a cantilever which is mounted so as to be moveable in a first direction and a second direction for offshore use;

c. a multi purpose tower fixably attached to the cantilever;

d. a supporting cart disposed between the cantilever and the deck of the Jack Up drilling rig;

e. at least four friction reducing devices secured to the supporting cart; wherein said friction reducing devices are plates comprising a material different from said cantilever and said Jack Up rig.

10. The system of claim 9, wherein the plates comprise an aluminum bronze alloy.

11. A system capable of being used offshore comprising:

a. a Jack-up drilling rig having a deck;

b. a cantilever which is mounted so as to be moveable in a first direction and a second direction for offshore use;

c. a multi purpose tower fixably attached to the cantilever;

d. a supporting cart disposed between the cantilever and the deck of the Jack Up drilling rig;

e. at least four friction reducing devices secured to the supporting cart; wherein said friction reducing devices are hydrostatic bearings.

12. A system capable of being used offshore comprising:

a. a Jack-up drilling rig having a deck;

b. a cantilever which is mounted so as to be moveable in a first direction and a second direction for offshore use;

c. a multi purpose tower fixably attached to the cantilever;

d. a supporting cart disposed between the cantilever and the deck of the Jack Up drilling rig;

e. at least four friction reducing devices secured to the supporting cart; wherein said friction reducing devices are a combination of plates comprising a material different from said cantilever and said Jack Up rig and hydrostatic bearings.

13. A system capable of being used offshore comprising:

a. a Jack-up drilling rig having a deck;

b. a cantilever which is mounted so as to be moveable in a first direction and a second direction for offshore use;

c. a multi purpose tower fixably attached to the cantilever, wherein said Multi Purpose tower is non-removably secured to the cantilever;

d. a supporting cart disposed between the cantilever and the deck of the Jack Up drilling rig;

e. at least four friction reducing devices secured to the supporting cart.

14. A method for installing drilling equipment on a sub-sea well and drilling the well comprising:

a. placing a Jack-Up platform having a deck with drilling equipment and a cantilever with a multi purpose tower near a well fixedly attached on the cantilever;

b. orienting the cantilever above the wellhead, using a translational movement by using a supporting cart between the cantilever and the deck;

c. picking up drill equipment from the Jack-Up platform using a multi purpose tower wherein said tower comprises a mast, on the top side provided with cable blocks fixedly connected to it; a trolley, which is movably fixed on the mast, and on the bottom side is provided with a gripper; a hoisting cable attached a winch, the hoisting cable being guided over the cable blocks of both the mast and the trolley, and it being possible to move the trolley relative to the mast with the aid of the hoisting cable;

d. placing the drilling equipment on the sub-sea well e. connecting the equipment to the sub-sea well; and f. drilling the well.

15. A method for decommissioning a well comprising:

a. placing a Jack-Up platform having a deck with drilling equipment and a cantilever and a multi purpose tower near a well fixedly attached on the cantilever;

b. orienting the cantilever above the wellhead, using translational movement by using a supporting cart between the cantilever and the deck;

c. disconnecting the drilling equipment from the well;

d. picking up the drilling equipment using a multi purpose tower wherein said tower comprises a mast, on the top side provided with cable blocks fixedly connected to it; a trolley, which is movably fixed on the mast, and on the bottom side is provided with a gripper; a hoisting cable attached a winch, the hoisting cable being guided over the cable blocks of both the mast and the trolley, and it being possible to move the trolley relative to the mast with the aid of the hoisting cable; and e. placing drilling equipment on the Jack-Up platform.

* * * * *